US005818480A

United States Patent [19]

Bern et al.

[11] Patent Number: 5,818,480

[45] Date of Patent: Oct. 6, 1998

[54] METHOD AND APPARATUS TO CONTROL ELECTRODES IN A PRINT UNIT

[75] Inventors: Bengt Bern, Mölndal; Ove Larson, Västra Frölunda; Per Klockar, Göteborg, all of Sweden

[73] Assignee: Array Printers AB, Sweden

[21] Appl. No.: 388,529

[22] Filed: Feb. 14, 1995

[51] Int. Cl.[6] ..... B41J 2/06

[52] U.S. Cl. ..... 347/55

[58] Field of Search ..... 355/261, 262; 347/55, 112, 141, 151, 142, 144, 128

[56] References Cited

U.S. PATENT DOCUMENTS

| | | | |
|---|---|---|---|
| 3,566,786 | 3/1971 | Kaufer et al. | 346/74.2 X |
| 3,689,935 | 9/1972 | Perssman et al. | 347/55 |
| 3,779,166 | 12/1973 | Pressman et al. | 347/124 |
| 4,263,601 | 4/1981 | Nishimura et al. | 347/55 |
| 4,274,100 | 6/1981 | Pond | 347/74 |
| 4,353,080 | 10/1982 | Cross | 347/143 |
| 4,384,296 | 5/1983 | Torpey | 347/77 |
| 4,386,358 | 5/1983 | Fischbeck | 347/55 |
| 4,470,056 | 9/1984 | Galetto et al. | 347/145 |
| 4,478,510 | 10/1984 | Fujii et al. | 347/55 |
| 4,491,794 | 1/1985 | Daley et al. | 324/228 |
| 4,491,855 | 1/1985 | Fujii et al. | 347/55 |
| 4,498,090 | 2/1985 | Honda et al. | 347/128 |

(List continued on next page.)

FOREIGN PATENT DOCUMENTS

| | | | |
|---|---|---|---|
| 12 70 856 | 6/1968 | Germany . | |
| 26 53 048 | 5/1978 | Germany . | |
| 44-26333 | 11/1969 | Japan . | |
| 55-55878 | 4/1980 | Japan . | |
| 55-84671 | 6/1980 | Japan . | |
| 55-87563 | 7/1980 | Japan . | |
| 58-044457 | 3/1983 | Japan . | |
| 58-155967 | 9/1983 | Japan . | |
| 62-13356 | 11/1987 | Japan . | |
| 04189554 | 8/1992 | Japan . | |
| 5208518 | 8/1993 | Japan | 347/55 |
| 93331532 | 12/1993 | Japan . | |
| 94200563 | 8/1994 | Japan . | |
| 9048151 | 2/1997 | Japan . | |
| 09118036 | 5/1997 | Japan . | |
| 2108432 | 5/1983 | United Kingdom . | |
| 9014960 | 12/1990 | WIPO . | |
| 9201565 | 2/1992 | WIPO . | |

OTHER PUBLICATIONS

E. Bassous et al., "The Fabrication of High Precision Nozzles by the Anisotropic Etching of (100) Silicon", *J. Electrochem. Soc.: Solid–State Science and Technology,* vol. 125, No. 8, Aug. 1978, pp. 1321–1327.

Jerome Johnson, "An Etched Circuit Aperture Array for TonerJet® Printing", *IS&T's Tenth International Congress on Advances in Non–Impact Printing Technologies,* 1994, pp. 311–313.

"The Best of Both Worlds," Brochure of Toner Jet® by Array Printers. *The Best of Both Worlds.* 1990.

*Primary Examiner*—Benjamin R. Fuller
*Assistant Examiner*—C. Dickens
*Attorney, Agent, or Firm*—Knobbe, Martens, Olson & Bear, LLP

[57] ABSTRACT

The present invention relates to a method and means to control one or several electrodes in a print unit, comprising: at least one toner carrier, electrode means, having apertures at least partly surrounded by said electrodes, at least one back electrode. The electrodes are connected to driving means to apply different levels of energy, an on-potential, to at least partly open passages through the apertures to allow passage of toner particles or, an off-potential to prevent the passage of toner particles provided on the toner carrier through the apertures towards the back electrode. The driving means of each electrode intended to permit passage of said toner particles is brought in a high resistive state, and the electrode means of the electrodes intended to block the passage of said toner particles are brought in a low resistive state. Then all electrodes are applied a dynamic potential.

23 Claims, 5 Drawing Sheets

U.S. PATENT DOCUMENTS

| | | | |
|---|---|---|---|
| 4,511,907 | 4/1985 | Fukuchi | 347/12 |
| 4,525,727 | 6/1985 | Kohashi et al. | 347/13 |
| 4,571,601 | 2/1986 | Teshima | 347/33 |
| 4,675,703 | 6/1987 | Fotland | 347/127 |
| 4,717,926 | 1/1988 | Hotomi | 347/55 |
| 4,743,926 | 5/1988 | Schmidlin et al. | 347/55 |
| 4,748,453 | 5/1988 | Lin et al. | 247/41 |
| 4,814,796 | 3/1989 | Schmidlin | 347/55 |
| 4,831,394 | 5/1989 | Ochiai et al. | 347/55 |
| 4,837,071 | 6/1989 | Tagoku et al. | 428/195 |
| 4,860,036 | 8/1989 | Schmidlin | 347/55 |
| 4,912,489 | 3/1990 | Schmidlin | 347/55 |
| 5,028,812 | 7/1991 | Bartky | 347/12 X |
| 5,036,341 | 7/1991 | Larsson | 347/55 |
| 5,038,159 | 8/1991 | Schmidlin et al. | 347/55 |
| 5,057,855 | 10/1991 | Damouth | 347/57 |
| 5,072,235 | 12/1991 | Slowik et al. | 347/19 |
| 5,083,137 | 1/1992 | Badyal et al. | 347/14 |
| 5,121,144 | 6/1992 | Larson et al. | 347/55 |
| 5,128,695 | 7/1992 | Maeda | 347/55 |
| 5,148,595 | 9/1992 | Doggett et al. | 347/148 X |
| 5,170,185 | 12/1992 | Takemura et al. | 347/55 |
| 5,181,050 | 1/1993 | Bibl et al. | 347/148 |
| 5,204,696 | 4/1993 | Schmidlin et al. | 347/55 |
| 5,204,697 | 4/1993 | Schmidlin | 347/55 |
| 5,214,451 | 5/1993 | Schmidlin et al. | 347/55 |
| 5,229,794 | 7/1993 | Honman et al. | 347/55 |
| 5,237,346 | 8/1993 | Da Costa et al. | 347/148 |
| 5,256,246 | 10/1993 | Kitamura | 216/17 |
| 5,257,045 | 10/1993 | Bergen et al. | 347/123 |
| 5,270,729 | 12/1993 | Stearns | 347/55 |
| 5,274,401 | 12/1993 | Doggett et al. | 347/148 |
| 5,307,092 | 4/1994 | Larson | 347/124 |
| 5,402,158 | 3/1995 | Larson | 347/151 |
| 5,450,115 | 9/1995 | Bergen et al. | 347/123 |
| 5,473,352 | 12/1995 | Ishida | 347/55 |
| 5,477,246 | 12/1995 | Hirabayashi et al. | 347/12 |
| 5,506,666 | 4/1996 | Masuda et al. | 347/156 X |
| 5,515,084 | 5/1996 | Larson | 347/55 |
| 5,617,129 | 4/1997 | Chizuk, Jr. et al. | 347/55 |
| 5,625,392 | 4/1997 | Maeda | 347/55 |
| 5,640,185 | 6/1997 | Kagayama | 347/55 |
| 5,650,809 | 7/1997 | Kitamura | 347/55 |
| 5,666,147 | 9/1997 | Larson | 347/55 |

METHOD AND APPARATUS TO CONTROL ELECTRODES IN A PRINT UNIT

TECHNICAL FIELD OF THE INVENTION

The present invention relates to a method and means to control one or several electrodes in a print unit, comprising:

at least one toner carrier, an electrode means, having apertures at least partly surrounded by said electrodes, at least one back electrode, wherein the electrodes are connected to driving means to apply different levels of energy, an on-potential, to at least partly open passages through the apertures to allow passage of toner particles or an off-potential to prevent the passage of toner particles provided on the toner carrier through the apertures towards the back electrode.

DESCRIPTION OF RELATED ART

U.S. Pat. No. 5,036,341 describes a method and device for generating images on an information carrier, such as paper, by means of an array of control electrodes located between a toner carrier and a back electrode. Control electrode means consists of a woven mesh of wire electrodes where the spaces between wires become apertures through which toner particles are attracted from the toner carrier towards the back electrode. By connecting the control electrodes wires to selectable potentials, the apertures can at least partly be opened or closed electrostatically to passage of toner particles. These parts are assembled in a print unit.

U.S. Pat. No. 5,121,144 describes an alternate control electrode means consisting of a thin insulating substrate with apertures. The apertures are surrounded by ring electrodes on one side of the substrate.

Other types of control electrodes are also known, for example as in UK 2,108,432 where electrodes are located on each side of an insulating substrate. A ring electrode surrounds each aperture on one side of the substrate while a common electrode surrounds all apertures on the opposite side of the substrate.

To open or close passages through the apertures in above described devices, each electrode is connected to a driving circuit, usually integrated in an integrated circuit (IC). To achieve a good printing result, each electrode must be supplied by a high voltage, e.g. 350 V, to increase the printing process insensibility for the surrounding environment.

The above-mentioned voltage value and other values provided below are given as non-limiting examples and depend on several parameters, such as the geometry of the print unit, i.e. the distances between the toner carrier, the electrode means and the back electrode, respectively, and the toner particles, the toner particle charges (negative or positive) etc.

The circuits, e.g. HV3137 and HV3527 that include the driving devices, are commercially available from Supertex Inc., USA.

Two known configurations of the driving means and connecting them to electrodes 16, here ring electrodes, are shown in FIGS. 1 and 2. The IC 19*a* includes several metal oxide silicon (MOS) transistors 20, in this case a nMOS-transistor. To simplify the description, only one transistor is shown. The transistor has a protection diode 22 connected between the source 25 and the drain 26 of the transistor 20. The substrate 27 of the transistor, and the source 25, according to FIG. 1 are connected to the off-potential $V_{off}$.

The gate 28 of the transistor 20 is directly or indirectly connected to the data input 29 of the IC 19*a*.

The schematic wiring diagram of the FIG. 1 is known as open drain, in which the drain 26 connected to the output 30 of the IC 19*a*, is coupled to a voltage source $V_a$ through a resistor 23 ($R_1$), so-called pull-up resistor (pull-down if a pMOS-transistor is used), which in the illustrated embodiment is 3 MΩ. The output 30 of the IC 19*a* is connected to the ring electrode 16 through conductor 24.

When the input 29 of the IC 19*a*, i.e. the gate signal, is low (e.g. 0 V) the transistor 20 does not conduct and the ring electrode 16 through the output 30 assumes $V_a$, at least partly. The voltage of the ring electrode causes an attraction field to pass through the aperture of the ring, attracting toner particles from the toner carrier 10 towards the back electrode 12.

The circuit, depending on the required rise or fall time, will consume power. For a resistor value of 3MΩ, the power consumption will be appr. 20 mW/channel (channel: the circuit from an input to an output.) 1500 channels in a print unit will generate appr. 30 W in an "off" state, i.e. non-printing state. If p-channel transistors are used this will be the case if all electrodes are used to print. This effect is transformed into heat energy in each resistor 23, which heat energy must be conducted away using cooling flanges or other cooling devices, such as cooling fans. The pull-up resistors also require space, which makes it difficult to manufacture more compact print units.

In a so-called push-pull configuration, as shown in FIG. 2 the resistors are eliminated. Every channel of the IC 19*b* consists of two transistors, one nMOS-transistor 20 and one pMOS-transistor 21 respectively. The input 29 of the IC 19*b*, directly or indirectly, preferably through other logic units (not shown) is connected to gates 28 of both transistors 20 and 21. In a circuit having the input directly connected to the gates, the n-transistor 20 (pull-down) array will connect the output to $V_{off}$ and the p-transistor 21 (pull-up) array will connect the output to $V_a$.

The disadvantage with this arrangement is, using present manufacturing technology, that the driving circuits cannot operate at voltages higher than 275 V, which is 50–75 V lower than claimed operation voltage.

FIG. 3 shows a schematic cross-section view through part of a print unit according to U.S. Pat. No. 5,036,341 and U.S. Pat. No. 5,121,144. The toner carrier consists of, a so-called developer roller 10, which rotates in a toner container (not shown) and attracts toner particles 14 to the roller surface by means of magnetic or electrostatic forces. Toner particles 14 are arranged in a thin layer on the developer roller 10 whose surface may be an electrically conducting or semiconducting material. Toner particles 14 become electrically charged with for example a negative polarity by friction contact with the surface material of the developer roller 10. An electrostatic field is established between the developer roller 10 and a back electrode 12 by for example grounding the developer roller and connecting 1500 volts to the back electrode. That electrostatic field will transport charged toner particles 15 from the developer roller through the apertures 17 surrounded by the electrodes 16 of the electrode unit 11 to the surface of an information carrier 13. This area is called print-zone 31. A control potential of for example −150 volts connected to the electrode 16 will modify the electrostatic field at the developer roller in the region of the control electrode, closing the aperture 17 to passage of toner particles. A control potential of for example +200 volts will modify the electrostatic field at the developer roller in the region of the control electrode, opening the aperture to passage of toner particles from the developer roller through the aperture to the information carrier 13.

If a positive charge polarity is created on the toner particle, a back electrode potential of for example −1500 V is used. A control potential of for example +200 V connected to the electrode 16 will modify the electrostatic field at the toner carrier in the region of the control electrode, closing the aperture 17 to passage of toner particles. A control potential of for example −150 V connected to the electrode 16 will modify the electrostatic field at the toner carrier in the region of the control electrode, opening the aperture 17 to passage of toner particles from the developer roller through the aperture to the information carrier 13.

Use of a cylindrical developer roller to bring toner particles close to the planar control electrode array causes the distance $l_k$ between the developer roller and each control electrode to depend on the location of the control electrode within the control electrode array. The $l_k$ distance for aperture A1 for example is larger than the $l_k$ distance for aperture A2. The variation of $l_k$ distance among the apertures is represented by $\Delta l_k$.

Variation of the $l_k$ distance among the control electrodes causes a variation in the electrostatic field for attracting toner particles from the developer roller. An approximate relation of control electrostatic field to the $l_k$ distance is shown in FIG. 4. Variations of the $l_k$ distance cause variations in the control electrostatic field which causes variation in the number of toner particles attracted to the surface of the information carrier. Those variations of toner particles cause undesirable variation in the printed image.

Means for field control is needed that can generate fields variable in respect of the distance $l_k$.

In known print units the back electrode 12 is connected to a power supply, delivering $V_b$=1500 V. The toner carrier 10 is connected to earth. The electrodes are controlled by applying different potentials. When no toner is transported, i.e. from the toner carrier to the back electrode, the ring electrode 16 is connected to −150 V and when the toner is transported the ring electrode is connected to +200 V. This means that several power supply means must be arranged to supply the needed power.

Another problem is that the power supplies must deliver high DC power, which makes them expensive. In the market there are cost-effective AC supplies, which through applying this invention could replace the expensive DC-supplies.

BRIEF DESCRIPTION OF THE INVENTION

One object of the present invention is to provide a method and means to overcome above-mentioned drawbacks. The present invention provides a device having better performance characteristics using less expensive components. Another object of the present invention is to provide a driving means which can be mounted directly on the electrode carrier, allowing manufacturing more compact print units. The driving means according to the present invention reduces the heat generation and the costs for elimination of the heat and at the same time it provides for the use of higher voltages for reducing the current and environment sensibility of the printing process.

These objects are achieved by bringing each driving means of the electrode intended to permit passage of said toner particles in a high resistive state, and bringing the driving means of the electrodes to block the passage of said toner particles to a low resistive state, and then connecting each electrode connected to the driving means having the high resistive state to a required on-potential by applying a dynamic potential to all the electrodes, whereby capacitive means is connected between at least a power source and the electrodes and the electrodes are connected to a driving means.

BRIEF DESCRIPTION OF THE DRAWINGS

In the following, the invention will be described with reference to the enclosed drawings, in which.

DETAILED DESCRIPTION OF THE EMBODIMENTS

In the present invention the electrodes are controlled by applying a potential to the electrodes intended for printing, i.e. opening passages for the toner particles through the apertures surrounded by the electrodes, to put the driving means of said electrodes in a high or low resistive state, depending on the type of the transistors used and the type and/or charge of the toner particles. If negative charged toner is used, then the electrodes, the driving means of which have the high resistive state, are applied a required print voltage $V_{on}$ or "on-voltage," e.g., +200, by applying a dynamic potential to all electrodes. The other electrodes, which are connected through the transistors (pulled) will maintain their potential, i.e. the non-printing or "off-voltage" $V_{off}$, e.g. −150 V. To obtain $V_{on}$=200 V, a potential difference of 350 V must be applied, i.e.+200 V-(−150) V=+350 V.

When using positive charged toner the electrodes, the driving means of which being in low resistive state, are applied required print voltage $V_{on}$ or "on-voltage," e.g., −150 V, by putting a dynamic potential to all electrodes. The other electrodes, which are connected through the transistors (pulled) will maintain their potential, i.e. the non-printing or "off-voltage", $V_{off}$, e.g. −200 V.

Figure 1:
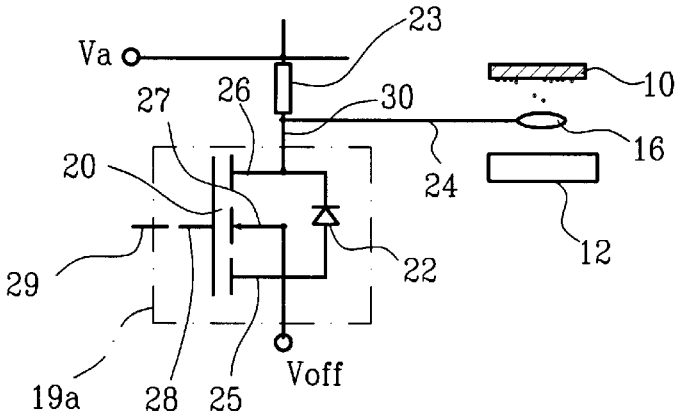
FIGS. 1 and 2 show schematic wiring diagrams of known embodiments.
Figure 2:
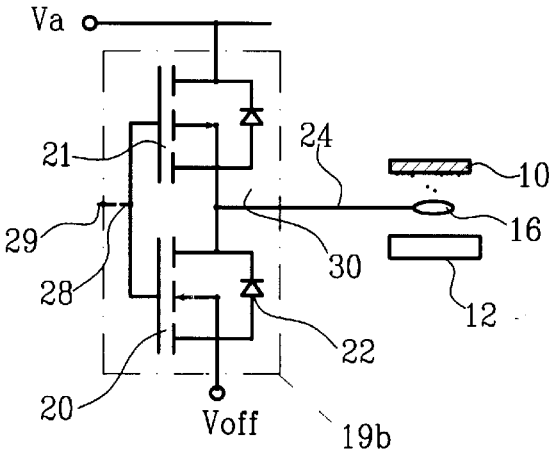
Figure 5:
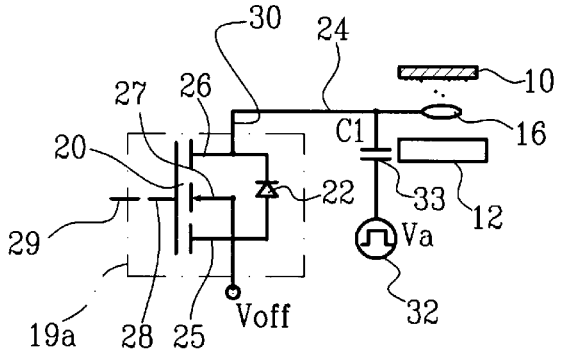
FIG. 5 is a schematic circuit diagram of a driving means according to the present invention.

The principle is also shown in the schematic circuit diagram of FIG. 5. This solution enables use of the same circuits as in FIG. 1. The drain of the transistor 20 is connected to the ring electrode 16 via the conductor 24, which can be energized through a control capacitor 33 ($C_1$). The function of the circuit is as follows; To allow an attraction field to attract the toner from the toner carrier 10 towards the back electrode 12, the data is sent to the input of the driving circuit 19*c*. In a preferred embodiment, assuming that the data has a high state, e.g. 5 V, the transistor 20 stops conducting, whereby the drain 26 assumes a high resistive state. The electrode 16 will now assume a "printing" state if a voltage is applied to it. The voltage is applied by means of a power supply 32, through $C_1$ in form of a pulse or step.

Figure 7:
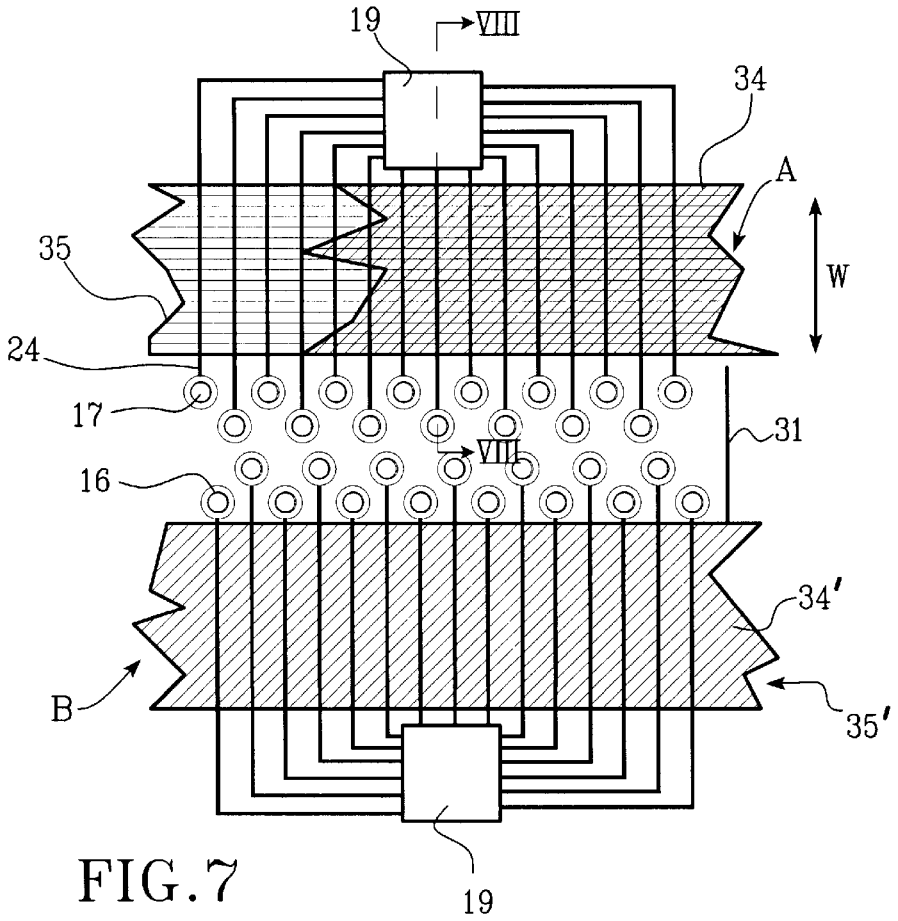
FIG. 7 is an plan view of the electrode means in an exaggerated scale, showing the capacitance plates according to the present invention.

Referring now to FIG. 7, the control capacitor $C_1$ is provided by locating at least one conductive plate 34 or 35, e.g. copper, on at least one side, preferably both sides of the electrodes, in the area where the conductors 24 extend from the ring electrodes 16, i.e. from the print-zone 31, to the driving circuits 19. It is possible to obtain a desired capacitance due to the extremely good geometry of the electrode means, which makes it possible to apply the external potential to all electrodes (the conductor part 24).

Figure 8:
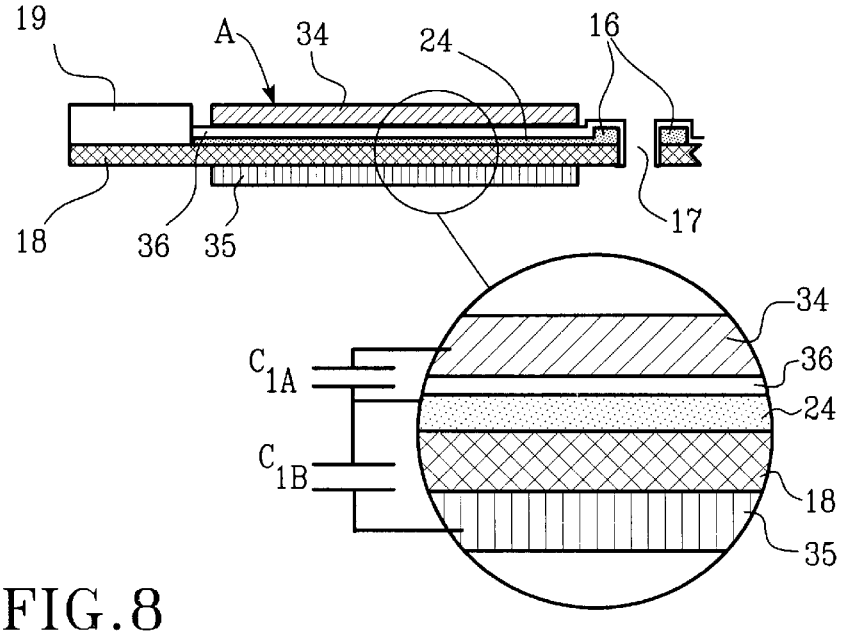
FIG. 8 is a cross-section in an exaggerated scale, through the embodiment shown in FIG. 7.

FIG. 8 shows a cross-section through a part of the embodiment shown in FIG. 7. The driver circuit 19 is mounted directly on the substrate member 18, on side A. The conductor 24 extends from the circuit 19 to the print-zone 31 and surrounds the aperture 17, forming the ring electrode 16. The conductor 24 and the ring electrode 16 are coated by a coating 36 of an insulating material.

Due to the electrical characteristics of the materials, the capacitors, $C_{1A}$ and $C_{1B}$, shown in the encircled enlargement, are formed between the plate 34 of side A and the conductors 24, and the conductors 24 and the plate 35 of side B, respectively. These capacitors $C_{1A}$ and $C_{1B}$, give the control capacitor $C_1(=C_{1A}+C_{1B})$ The plates 34, 35 and 34' and 35', on each side of the print-zone are connected to at least one power source, not shown, which supplies a high voltage $V_a$, preferably in form of a pulse/pulses or steps (switched high voltage).

Figure 6:
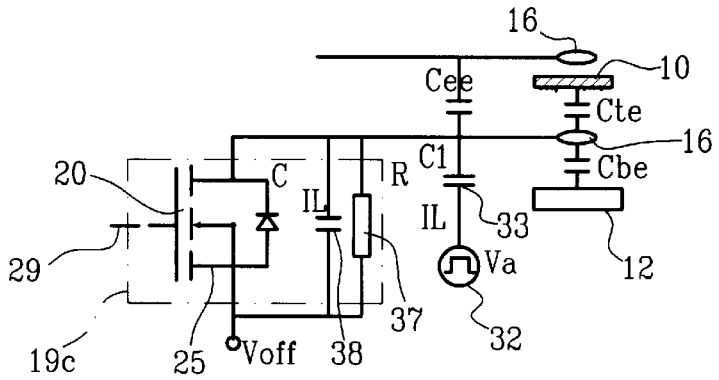
FIG. 6 is a more detailed schematic circuit diagram of a driving means according to the present invention.

The schematic circuit diagram of FIG. 6 shows a more detailed and accurate wiring diagram, in which some other, so-called load capacitors, produced due to the electrical characteristics of the material are illustrated.

The voltage, $V_{on}$, applied to transport the toner is less than the applied voltage $V_a$, due to these extra load capacitances (and load resistances, not shown). The load capacitances can be found between the adjacent electrodes/conductors 16/24 $C_{ee}$, between the back electrode 12 and the electrodes 16 $C_{be}$, between the toner carrier 10 and the electrodes 16 $C_{te}$, and also inside the circuit 19 there is a load capacitance $C_{iL}$ and a load resistor $R_{iL}$ (given as sum of all internal load capacitances and resistors). All capacitances are summed up to a load capacitance $C_L$, i.e. $C_L=C_{ee}+C_{be}+C_{te}+C_{iL}$.

Figure 10:
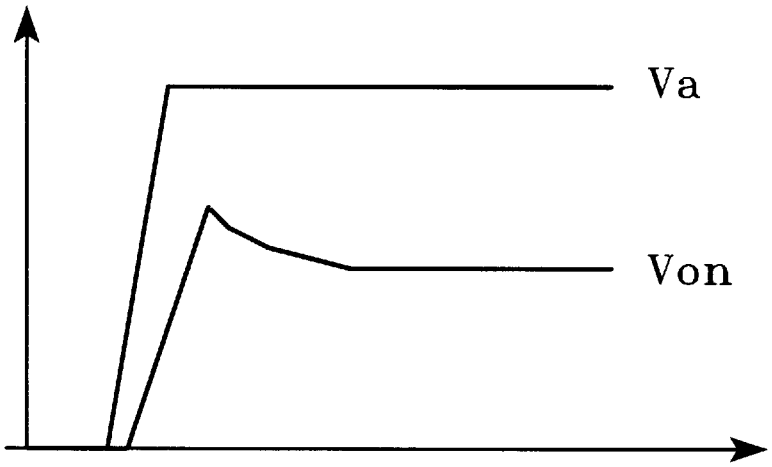
FIG. 10 shows in a diagram the relationship between $V_a$ and $V_{on}$.

The relationship between $V_{on}$ and $V_a$ is illustrated in the diagram of FIG. 10. A momentary value for $V_{on}$, i.e. the top value of the graph $V_{on}$, is calculated using equation 1;

$$V_{on} = \frac{C_1}{C_1 + C_L} \times V_a \tag{1}$$

For example for $C_1$=10 pF and $C_L$=5 pF, $V_{on}$ will be ⅔ of $V_a$, and thereby for $V_a$=600 V, $V_{on}$ will be 400 V.

Generally, the value of a capacitance C is calculated using equation 2:

$$C = \epsilon \frac{l \times w}{d} \tag{2}$$

where $\epsilon=\epsilon_o\times\epsilon_r$, $\epsilon$ is the dielectric constant, $\epsilon_o$ is constant=$1/(36\ \pi)\times10^{-9}$ $\epsilon_r$ is the dielectric constant for the material between the conductors;

l=length of the conductors;

w=width of the conductors; and d=the distance between the conductors.

When there are different material and/or dimensions the value of the capacitance is calculated using equation 3:

$$C_1 = \epsilon_1 \frac{l_1 \times w_1}{d_1} + \epsilon_2 \frac{l_2 \times w_2}{d_2} \tag{3}$$

where $\epsilon_{1/2}=\epsilon_o\times\epsilon_{1/2}r$, $\epsilon$ is the dielectric constant, $\epsilon_o$ is constant=$1/(36\ \pi)\times10^{-9}$ $\epsilon_{1/2}$rare the dielectric constants for the different materials between the conductors;

$l_{1/2}$=lengths of the conductors;

$w_{1/2}$=width of the conductors; and $d_{1/2}$=the thickness of the different materials used between the conductors.

According to equation 1, it is obvious that the on-voltage can be controlled by varying the value of the $C_1$, which in turn, according to equation 2 depends on the mechanical parameters l, w and d.

Figure 3:
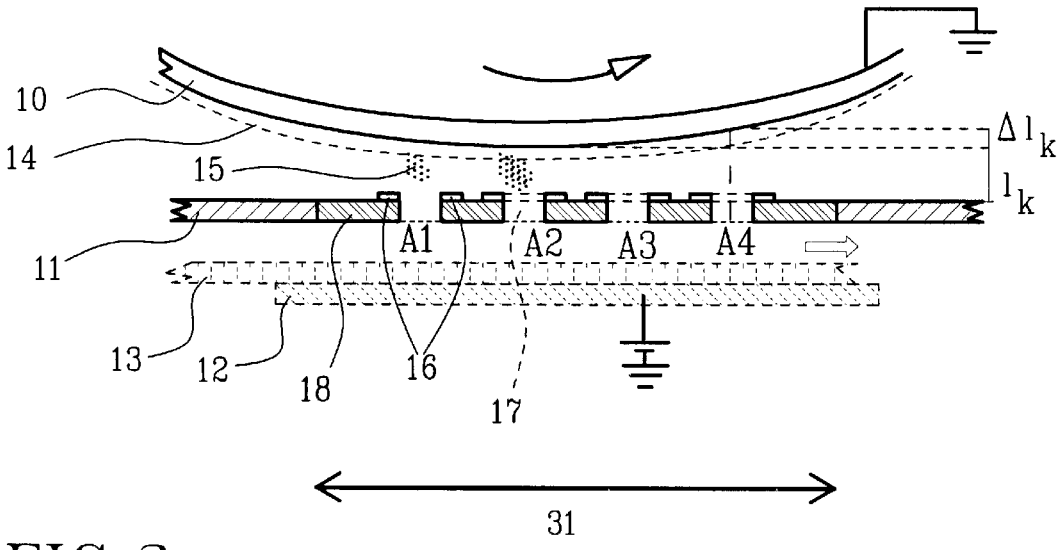
FIG. 3 shows a schematic cross-section through part of a print unit.
Figure 4:
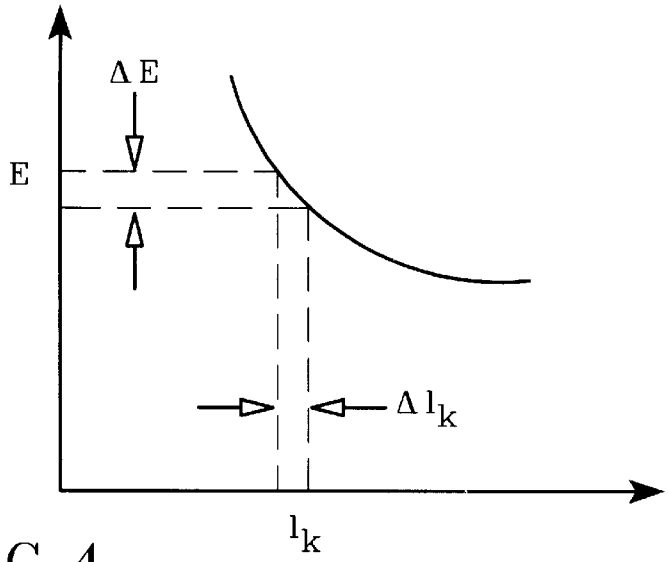
FIG. 4 shows a diagram disclosing the relationship between the distance $l_k$ and the field E.
Figure 9:
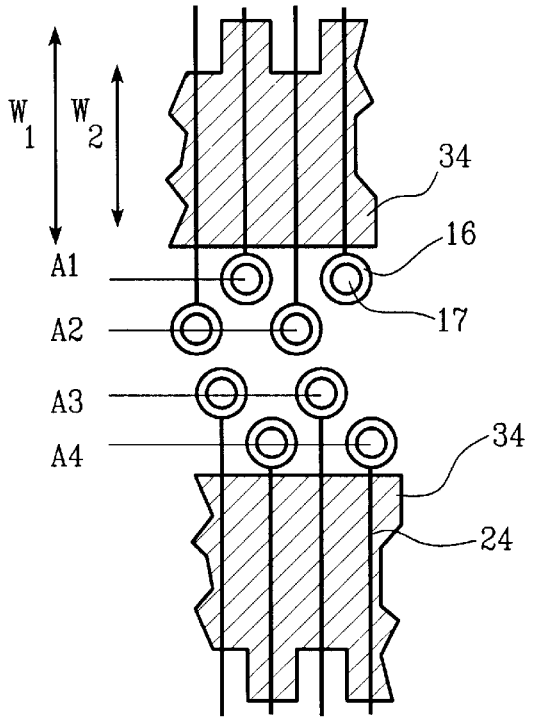
FIG. 9 is an plan view of another embodiment showing the capacitance plates according to the present invention.

As mentioned above, one problem in a print unit having a developer roller is the variation of the distance $l_k$, which is known because of the known radius of the developer roller. Referring to FIGS. 3 and 4, it is evident that the problem can be solved by varying the potential applied to each ring electrode 16, i.e. applying higher potential, $V_a$, to the ring electrodes having longer distance to the developer roller. In the case according to FIG. 3 the apertures A1 and A4 must receive higher potential than the apertures A2 and A3. This can be obtained by the fact that if $C_1$ increases, $V_{on}$ will increase, and $C_1$ increases if, for example w increases. Bearing this in mind, the embodiment shown in FIG. 9 shows a simple solution. Analogous to FIG. 3 the apertures are designated A1–A4, where A1 and A4 have longer distance to the developer roller than A2 and A3. By varying the width of the capacitor plates 34, $V_{on}$ can be varied, i.e. $V_{on}$ applied to the apertures, A1 or A4, the conductors 24 of which extends a longer distance between the capacitor plates 34, i.e. $w_1$, will be higher than $V_{on}$ for apertures, A2 or A3, the conductors 24 of which extends a shorter distance between the capacitor plates 34, i.e. $w_2$. This solution compensates the $\Delta l_k$.

Figure 11:
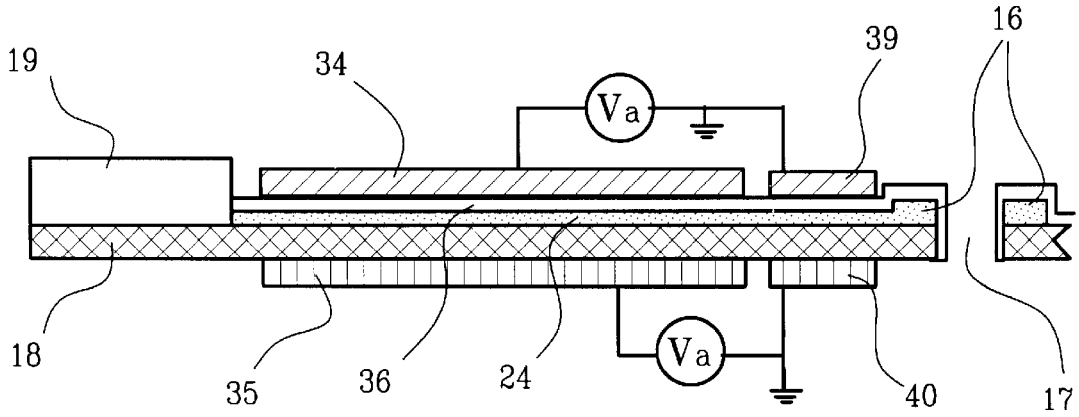
FIG. 11 shows a cross-section view through a third embodiment having several capacitance plates.

Using $C_1$ provides several other improvements. As mentioned above, until now there has been a need for several power supplies, e.g. one for back electrode and one for the electrodes. Using $C_1$ makes it possible to utilize the high voltage applied to the back electrode, to adapt the $V_a$ to the power supplied to the back electrode, $V_{be}$. This is obtained by varying the area of the capacitor $C_1$ by, for example reducing the width of the plates, and introducing additional plates 39 and 40, as shown in FIG. 11. Through connecting the plates 39 and 40, so-called shield plates to earth, a new load capacitor, $C_s$, will be provided. The voltage applied on the conductor 24 will depend on $C_1/C_s\approx w_1/w_s$, where $w_1$ is the width of the $C_1$-plates and $w_s$ is the width of the $C_s$-plates. The voltage applied to the back electrode is converted to AC-voltage and then connected to the plates 34 and 35. It is also possible to apply AC-voltage to the back electrode, where by no conversion is needed.

Figure 12:
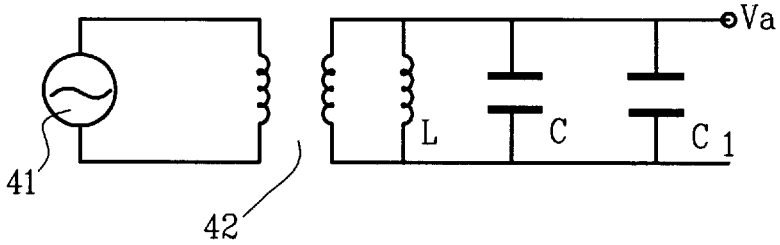
FIG. 12 shows a schematic circuit of a power supply embodiment using a capacitor according to the present invention.

By using the control capacitance $C_1$ in a resonance circuit, FIG. 12, it is possible to use a power supply, delivering AC-voltage, to generate the pulsating $V_a$. FIG. 12 shows the schematic circuit diagram for a simple circuit. The power of an AC-supply 41 is transformed (up or down) to a wanted level by the transformer 42. A simple resonance circuit consisting of a capacitor C and a coil L (usually one coil of the transformer 42) in cooperation with the control capacitor $C_1$ are used to produce the desired $V_a$ pulses. $C_1$ should have a lower value than C. It is also possible to add a circuit to transform the AC to DC power to be used wherever it is needed. The advantages using this solution are:

The reasonable costs for transforming up $V_a$ instead of switching it;

Lower power consumption using the resonance circuit;

Lower EMI (electro magnetic interference).

Of course, it is possible to use the underlying basic ideas of the present invention in print units having different electrode means, for example electrode means shown in U.S. Pat. No. 5,036,341 or UK 2,108,432.

The electrode means according to the first document has a print-zone consisting of woven or each other crossing electrodes. It is also possible to provide plates in the region between the print-zone and the driving circuits. All of those above-mentioned configurations are applicable on the net shaped electrodes.

Figure 13:
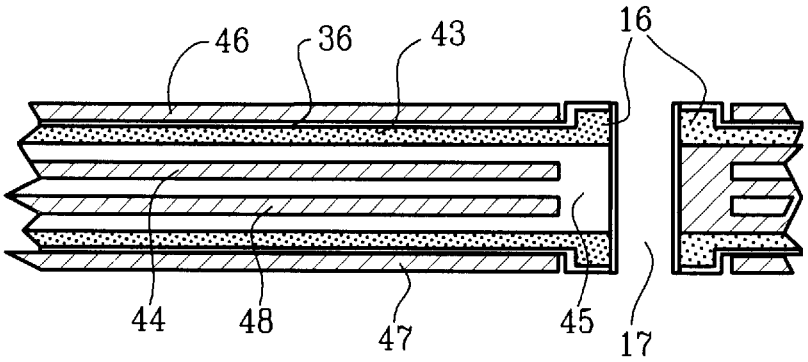
FIG. 13 shows another embodiment having electrodes on both sides of the substrate.

Also the electrode means of UK 2,108,432 can be provided with capacitor means according to the present invention. In this case to obtain good potential characteristics, the electrode layers 43 and 44 on each side of the insulating substrate 45 are provided with capacitor plates 46 and 47 above each layer and at least one plate 48 in the substrate, as shown in FIG. 13. Also, here all the benefits of the present invention will be achieved.

The embodiments described above and illustrated in the drawings are given as non-limiting examples. Of course, it is possible to modify the embodiments by adding, removing or combining different parts as long as the modifications are within the scope of the enclosed claims. For example the level and the frequency of the voltages can be varied with regard to the types of the toner and electrode types. The transistors can be substituted by other type of transistors or other switching means able to deliver the required power. Also, it is possible to vary other parameters of equation 3 to vary the value of $C_1$, e.g. the thickness of the substrate conveying the electrodes. Likewise, the plates can be made of semi-conductive material as long as they fulfill the claimed electrical characteristics.

In a non-limiting preferred embodiment following dimensions are obtained:

The width of the conductors are 110±100 μm, the ring electrodes have diameter of 320±300 μm, the apertures 30–250 μm. The toner particles have 4–70 μm in diameter. The distance between the nearest point of the developer roller and the electrode means is 100±80 μm and between the electrode means and the back electrode 500±300 μm.

LIST OF THE DESIGNATION SIGNS

| | | | |
|---|---|---|---|
| 10 | Toner carrier | C | Resonance circuit capacitance |
| 11 | Electrode means | | |
| 12 | Back electrode | $C_1$ | Control capacitance |
| 13 | Information carrier | $C_{1A}$ | Capacitance side A |
| 14 | Toner layer | $C_{1B}$ | Capacitance side B |
| 15 | Toner particles | $C_{be}$ | Capacitance between electrode/back electrode |
| 16 | Ring electrode | | |
| 17 | Aperture | $C_{ee}$ | Capacitance between electrode/electrode |
| 18 | Electrode substrate | | |
| 19 | IC | $C_{te}$ | Capacitance between electrode/toner carrier electrode |
| 20 | n-channel transistor | | |
| 21 | p-channel transistor | | |

-continued

| | | | |
|---|---|---|---|
| 22 | Protection diode | $C_L$ | Load capacitance |
| 23 | Resistor | $C_{iL}$ | Internal load capacitance |
| 24 | Conductor | L | Coil |
| 25 | Transistor source | $R_1$ | Pull-up resistor |
| 26 | Transistor drain | $R_{iL}$ | Internal load resistor |
| 27 | Transistor substrate | R | Resonance circuit resistor |
| 28 | Transistor gate | | |
| 29 | Input | $V_a$ | V applied |
| 30 | Output | $V_{off}$ | No print V |
| 31 | Print-zone | $V_{on}$ | Print V |
| 32 | Supply | | |
| 33 | Control capacitor, $C_1$ | | |
| 34 | Conductive plate A | | |
| 35 | Conductive plate B | | |
| 36 | Coating | | |
| 37 | Load resistor | | |
| 38 | Load capacitor | | |
| 39 | Capacitor plate | | |
| 40 | Capacitor plate | | |
| 41 | AC power supply | | |
| 42 | Transformer | | |
| 43 | Electrode layer | | |
| 44 | Electrode layer | | |
| 45 | Insulating layer | | |
| 46 | Capacitor plate | | |
| 47 | Capacitor plate | | |
| 48 | Capacitor plate | | |

We claim:

1. A method for controlling electrodes in a print unit, wherein the print unit includes a toner carrier for carrying toner particles; an electrode array having at least a first aperture and a second aperture, said first aperture at least partly surrounded by a first aperture electrode and said second aperture at least partly surrounded by a second aperture electrode; a back electrode; and a first electrode driver and a second electrode driver respectively coupled to said first aperture electrode and to said second aperture electrode to drive said first aperture electrode and said second aperture electrode at different levels of potential, said levels of potential including an on-potential applied to said first aperture electrode to enable passage of toner particles through said first aperture and an off-potential applied to said second aperture electrode to block passage of toner particles through said second aperture, the method comprising the steps of:

controlling said first electrode driver to cause said first electrode driver to have a high resistance state;

controlling said second electrode driver to cause said second electrode driver to have a low resistance state which couples said off-potential through said second electrode driver to said second aperture electrode; and capacitively caupling a dynamic potential to said first aperture electrode and to said second aperture electrode, said high resistance state of said first electrode driver allowing said dynamic potential to provide said on-potential to said first aperture electrode to thereby enable passage of toner particles through said first aperture, said low resistance state of said second electrode driver maintaining said second aperture electrode at said off-potential such that passage of toner particles through said second aperture is blocked.

2. The method as defined in claim 1, wherein said off-potential is applied by bringing said second electrode driver to said low resistance state to thereby couple said off-potential through said second electrode driver to said second aperture electrode.

3. The method as defined in claim 1, wherein said on-potential is applied to said first aperture electrode through a control capacitor.

4. A method for controlling electrodes in a print unit, wherein the print unit includes a toner carrier for carrying toner particles; an electrode array having at least a first aperture and a second aperture, said first aperture at least partly surrounded by a first aperture electrode and said second aperture at least partly surrounded by a second aperture electrode; a back electrode; and a first electrode driver and a second electrode driver respectively coupled to said first aperture electrode and to said second aperture electrode to drive said first aperture electrode and said second aperture electrode at different levels of potential, said levels of potential including an on-potential applied to said first aperture electrode to enable passage of toner particles through said first aperture and an off-potential applied to said second aperture electrode to block passage of toner particles through said second aperture, the method comprising the steps of:

controlling said first electrode driver to cause said first electrode driver to have a low resistance state which couples said on-potential through said first electrode driver to said first aperture electrode;

controlling said second electrode driver to cause said second electrode driver to have a high resistance state; and capacitively caupling a dynamic potential to said first aperture electrode and said second aperture electrode, said low resistance state of said first electrode driver maintaining said first aperture electrode at said on-potential to thereby enable passage of toner particles through said first aperture, said high resistance state of said second electrode driver allowing said dynamic potential to provide said off-potential to said second aperture electrode such that passage of toner particles through said second aperture is blocked.

5. The method as defined in claim 4, wherein said on-potential is applied by bringing said first electrode driver to said low resistance state to thereby couple said on-potential through said first electrode driver to said first aperture electrode.

6. The method as defined in claim 4, wherein said off-potential is applied to said second aperture electrode through a control capacitor.

7. A print unit comprising:

a toner carrier for carrying toner particles;

an electrode array in a print zone proximate to said toner carrier, said electrode array comprising at least a first aperture and a second aperture, said first aperture at least partly surrounded by a first aperture electrode and said second aperture at least partly surrounded by a second aperture electrode;

a back electrode positioned proximate to said electrode array and spaced apart from said electrode array by a distance sufficient to permit an information carrier to move between said back electrode and said electrode array;

a first electrode driver and a second electrode driver respectively coupled to said first aperture electrode and to said second aperture electrode to drive said first aperture electrode and said second aperture electrode at different levels of potential, said levels of potential including an on-potential applied to said first aperture electrode to enable passage of toner particles through said first aperture and an off-potential applied to said second aperture electrode to block passage of toner particles through said second aperture;

at least one power source; and a first capacitance interposed between said power source and said first aperture electrode and a second capacitance interposed between said power source and said second aperture electrode to couple said power source to said first aperture electrode and to said second aperture electrode through said first capacitance and said second capacitance, respectively.

8. The print unit as defined in claim 7, wherein said first capacitance comprises a capacitor.

9. The print unit as defined in claim 8, wherein said capacitor comprises at least one conductive or semi-conductive plate arranged on at least one side of said array of electrodes.

10. The print unit as defined in claim 9, wherein said plate is divided into a plurality of smaller plates.

11. The print unit as defined in claim 10, wherein said smaller plates have variable sizes.

12. The print unit as defined in claim 8, wherein said capacitor comprises at least one conductive plate arranged on at least one side of said electrode array, said at least one conductive plate extending at least partly between said first aperture electrode and said first electrode driver and at least partly between said second aperture electrode and said second electrode driver.

13. The print unit as defined in claim 12, wherein said plate is divided into a plurality of smaller plates.

14. The print unit as defined in claim 13, wherein said smaller plates have variable sizes.

15. The print unit as defined in claim 7, wherein said electrode array comprises a substrate and an electrode layer wherein said first aperture electrode and said second aperture electrode are positioned on one side of said substrate and surround said first aperture and said second aperture, respectively.

16. The print unit as defined in claim 7, wherein said electrode array comprises at least two electrode layers and a substrate, said at least two electrode layers comprising said first aperture electrode and said second aperture electrode on each said of said substrate, said first aperture electrode and said second aperture electrode surrounding said first aperture and said second aperture, respectively.

17. The print unit as defined in claim 7, wherein:

said electrode array in said print zone comprises a woven mesh of wire electrodes; and spaces between said wire electrodes form said first and second apertures.

18. The print unit as defined in claim 7, wherein said first electrode driver comprises at least one transistor.

19. The print unit as defined in claim 18, wherein said transistor is a MOS transistor.

20. A print unit comprising:

a toner carrier for carrying toner particles, said toner carrier shaped as a cylindrical roller;

an electrode array in a print zone proximate to said toner carrier, said electrode array comprising at least a first aperture and a second aperture, said first aperture at least partly surrounded by a first aperture electrode and said second aperture at least partly surrounded by a second aperture electrode;

a back electrode positioned proximate to said electrode array and spaced apart from said electrode array by a distance sufficient to permit an information carrier to move between said back electrode and said electrode array;

a first electrode driver and a second electrode driver respectively coupled to said first aperture electrode and to said second aperture electrode to drive said first aperture electrode and said second aperture electrode at different levels of potential, said levels of potential including an on-potential applied to said first aperture electrode to enable passage of toner particles through said first aperture and an off-potential applied to said second aperture electrode to block passage of toner particles through said second aperture;

at least one power source; and a first capacitance interposed between said power source and said first aperture electrode and a second capacitance interposed between said power source and said second aperture electrode to couple said power source to said first aperture electrode and said second aperture electrode through said first capacitance and said second capacitance, respectively, said first capacitance and said second capacitance comprising at least one conductive plate positioned proximate to said first aperture electrode and said second aperture electrode.

21. The print unit as defined in claim 20, wherein:

said first aperture electrode extends a first distance proximate to said conductive plate;

said second aperture electrode extends a second distance proximate to said conductive plate;

said first aperture is spaced further from said cylindrical roller than said second aperture; and said first distance is longer than said second distance.

22. A print unit comprising:

a toner carrier for carrying toner particles;

an electrode array in a print zone proximate to said toner carrier, said electrode array comprising at least a first aperture and a second aperture, said first aperture at least partly surrounded by a first aperture electrode and said second aperture at least partly surrounded by a second aperture electrode;

a power supply;

a back electrode electrically connected to said power supply, said back electrode positioned proximate to said electrode array and spaced apart from said electrode array by a distance sufficient to permit an information carrier to move between said back electrode and said electrode array;

a first electrode driver electrically coupled to said first aperture electrode and a second electrode driver electrically coupled to said second aperture electrode to respectively drive said first aperture electrode and said second aperture electrode at different levels of potential, said levels of potential including an on-potential applied to said first aperture electrode to enable passage of toner particles through said first aperture and an off-potential applied to said second aperture electrode to block passage of toner particles through said second aperture; and a capacitance comprising:

at least one conductive plate positioned on at least one side of said first aperture electrode and said second aperture electrode, said at least one plate covering a respective first portion of each of said first aperture electrode and said second aperture electrode; and shielding plates arranged on at least one side of each of said first aperture electrode and said second aperture electrode to cover a respective second portion of each of said first aperture electrode and said second aperture electrode, said shielding plates coupled to said power supply.

23. A print unit comprising:

a toner carrier for carrying toner particles;

an electrode array in a print zone proximate to said toner carrier, said electrode array comprising at least a first aperture and a second aperture, said first aperture at least partly surrounded by a first aperture electrode and said second aperture at least partly surrounded by a second aperture electrode;

a back electrode positioned proximate to said electrode array and spaced apart from said electrode array by a distance sufficient to permit an information carrier to move between said back electrode and said electrode array; and a first electrode driver coupled to said first aperture electrode and a second electrode driver coupled to said second aperture electrode to drive said first aperture electrode and said second aperture electrode at different levels of potential, said levels of potential including an on-potential capacitively coupled to said first aperture electrode to enable passage of toner particles through said first aperture and an off-potential capacitively coupled to said second aperture electrode to block passage of toner particles through said second aperture, wherein each of said first aperture electrode and said second aperture electrode comprises:

a conductor portion having a width of 110±100 $\mu$m; and a ring electrode portion having a diameter of 320±300 $\mu$m, wherein:

said first aperture and second aperture have diameters of 30–250 $\mu$m;

said toner particles have diameters of 4–70 $\mu$m;

a distance between a nearest point of said toner carrier and one of said first aperture electrode and said second aperture electrode is 100±80 $\mu$m; and a distance between said first aperture electrode and said second aperture electrode and said back electrode is 500±300 $\mu$m.

* * * * *

UNITED STATES PATENT AND TRADEMARK OFFICE

CERTIFICATE OF CORRECTION

PATENT NO. : 5,818,480
DATED : October 6, 1998
INVENTOR(S) : Bengt Bern et al.

It is certified that error appears in the above-identified patent and that said Letters Patent is hereby corrected as shown below:

Column 8,
Line 50, change "caupling a" to -- coupling a --.

Column 9,
Line 25, change "caupling a" to -- coupling a --.

Signed and Sealed this

Second Day of April, 2002

*Attest:*

*Attesting Officer*

JAMES E. ROGAN
*Director of the United States Patent and Trademark Office*